United States Patent [19]

Escaravage

[11] Patent Number: 4,685,177

[45] Date of Patent: Aug. 11, 1987

[54] BUCKLE, ESPECIALLY FOR A SAFETY BELT FOR AN AUTOMOBILE VEHICLE

[75] Inventor: Gerard Escaravage, Valentigney, France

[73] Assignee: Aciers et Outillage Peugeot, Audincourt, France

[21] Appl. No.: 885,622

[22] Filed: Jul. 15, 1986

[30] Foreign Application Priority Data

Jul. 17, 1985 [FR] France ..... 85 10964

[51] Int. Cl.[4] ..... A44B 11/25

[52] U.S. Cl. ..... 24/641; 24/651

[58] Field of Search ..... 24/636–638, 24/640, 641, 643, 651, 633; 297/468

[56] References Cited

U.S. PATENT DOCUMENTS

| | | | |
|---|---|---|---|
| 3,340,578 | 9/1967 | Straozht et al. | 24/641 X |
| 4,096,606 | 6/1978 | Stephenson . | |
| 4,492,007 | 1/1985 | Tolfsen | 24/637 X |
| 4,575,907 | 3/1986 | Takada | 24/641 |

FOREIGN PATENT DOCUMENTS

| | | | |
|---|---|---|---|
| 14787 | 11/1971 | Australia . | |
| 0040143 | 11/1981 | European Pat. Off. . | |
| 0098726 | 1/1984 | European Pat. Off. . | |
| 0114332 | 8/1984 | European Pat. Off. . | |
| 2423176 | 12/1979 | France | 24/641 |
| 2071753 | 9/1981 | United Kingdom . | |
| 2073810 | 10/1981 | United Kingdom | 24/637 |

*Primary Examiner*—Kenneth J. Dorner
*Assistant Examiner*—James R. Brittain
*Attorney, Agent, or Firm*—Sughrue, Mion, Zinn, Macpeak & Seas

[57] ABSTRACT

This buckle comprises, housed in a casing (1), a body (4), a member for locking (5) a bolt, a sliding block (10) mounted in the body so as to be capable of travelling in the direction of travel of the bolt and which cooperates with a spring (12) for ejecting the bolt, another spring (16) pressing the locking member towards its position in which the bolt is locked, and a member for producing (6) unlocking for moving the locking member towards its position in which the bolt is unlocked. The sliding block (10) is mounted so that it can travel between a forward position, in which a first bearing surface of the locking member (5) bears against the sliding block (10), corresponding to the position in which the bolt is unlocked, and a rear position, in which the locking member has oscillated relative to the body so that a second bearing surface of the locking member bears against this sliding block, this rear position of the sliding block corresponding to the position in which the bolt is locked.

13 Claims, 9 Drawing Figures

BUCKLE, ESPECIALLY FOR A SAFETY BELT FOR AN AUTOMOBILE VEHICLE

The present invention relates to devices intended to restrain a passenger in his or her seat in an automobile vehicle in the event of a sudden deceleration of the latter, for example during emergency braking or in a collision.

More particularly, the invention relates to a buckle which, in a device of the kind indicated, is intended to attach in a removable manner a length of a safety belt to a fixed point of the vehicle body, for example by means of a tab acting as a lock bolt.

In the state of the art, there are known buckles comprising a casing, in which is placed a stirrup-shaped carrier intended to be fixed to a means of restraint fixed relative to the vehicle body and which, between its arms, defines a guidance passage for the bolt which opens at one end of this stirrup. These buckles also comprise a locking member mounted so that it oscillates in the stirrup around a pivot which is perpendicular to the arms of this stirrup, as well as a stop member mounted so that it slides within these arms and which can be made ineffective by means of a control button, against the action of a resilient return device.

In buckles of this type, the bolt is retained in the buckle by a projecting portion of the locking member which prevents the withdrawal of the bolt from the locking passage, for example by entering an opening provided in the bolt. In the event of a hard pull on the belt which tends to withdraw the bolt from the buckle, this projecting portion cooperates with a stop edge provided in the bottom of the carrier stirrup, if appropriate by elastic deformation of the pivot for oscillation of the locking member in the stirrup, and this enables the buckle to be endowed with a high efficiency and the bolt with a considerable retaining strength.

Also known, from the document FR-2,482,430, is a buckle for a safety belt comprising a carrier intended to be attached to a means for restraint and defining a rectilinear passage into which the bolt may be introduced and which defined a sliding point for the latter. The bolt-which locking member is articulated to the carrier around a pivot which lies parallel to the plane of the passage. This locking member may have a first abutment surface retaining the bolt and lying perpendicular to the plane of the passage, while being transverse relative to the latter, in the locked position of the buckle, while the locking member may also have at least one second abutment surface which is intended, in the locked position of the buckle, to come into contact with a stop member mounted so that it moves in translation on the carrier, in a direction at right angles to the axis of articulation of the locking member. The travel of this stop member releases the locking member and hence the bolt during the opening of the buckle, which is controlled by an operating button mounted on the carrier so that it can travel in the same direction as the stop member.

Return springs are provided for acting on the locking member, the stop member and the operating button. The stop member consists of a single-block body which has members for guiding and retaining the springs extending on both sides of this body in opposite directions at right angles to the axis of articulation of the locking member.

The construction of devices of this kind has a number of disadvantages, particularly in respect of the observance of fairly tight tolerances during manufacture, and this increases the production cost of devices of this kind. Furthermore, in modern automobile technology the aim is to reduce the weight and the bulk of equipment as much as possible, in all respects and especially where safety equipment is concerned, without, of course, compromising thereby the efficiency of such equipment.

The purpose of the invention is therefore to provide a safety belt buckle which is simple in construction and easy to fit, by reducing the number of members of which such a buckle is made up.

Another purpose of the invention is to provide a safety belt buckle which is smaller and lighter than the buckles of the prior art and whose manufacture may be undertaken without the need to observe tight tolerances.

To this end, the subject of the invention is a buckle, particularly for a safety belt for an automobile vehicle, which is intended to attach in a removable manner a length of the said belt to a fixed point of the vehicle body, comprising a catch assembly and a bolt forming an integral part of the length to be attached, the catch assembly comprising, housed in a casing, a body intended to be attached to a means of restraint forming an integral part of the vehicle and which defines a passage and a plane of sliding for the said bolt, a member for locking the bolt comprising an operating portion which engages in a cavity in the bolt in the position in which the latter is locked, and articulated to the body so as to be capable of swinging around a pivot which is approximately parallel to the plane of sliding and perpendicular to the direction of travel of the bolt, between a position in which the said bolt is locked and a position in which it is unlocked, a sliding block mounted in the said body so as to be capable of travelling along the direction of travel of the bolt and which cooperates, on the one hand, with a front face of the bolt and, on the other hand, with a spring for ejecting the bolt, means pushing the locking member towards its position in which the bolt is locked and means for producing unlocking for moving the locking member towards its position in which the bolt is unlocked, characterized in that the said sliding block is mounted so that it can travel between a forward position, in which a first bearing surface of the locking member bears against this sliding block, corresponding to the position in which the bolt is unlocked, and a rear position, in which the locking member has oscillated relative to the said body so that a second bearing surface of the locking member bears against the sliding block, corresponding to the position in which the bolt is locked.

The invention will be better understood with the aid of the following description which is given solely by way of example and given with reference to the attached drawings, in which.

Figure 1:
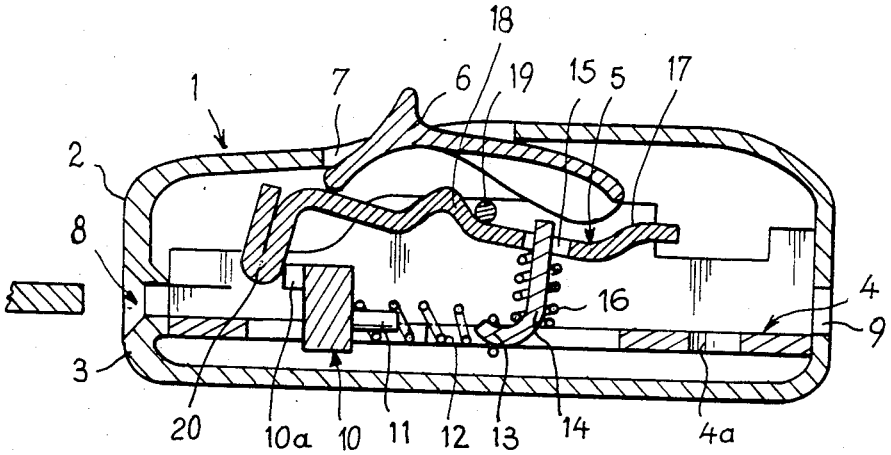
FIGS. 1 to 4 illustrate the operation of a safety belt buckle according to the invention.

As shown in FIG. 1, a safety belt buckle according to the invention comprises a casing 1 consisting in a manner which is known per se of an upper component 2 and a lower component 3. Inside this casing 1 is arranged a catch assembly comprising a body 4 whose section is generally U-shaped. A locking member 5, which is in the form of a metal blade and which will be described in further detail later, is housed inside this body 4. A member for producing unlocking 6 is mounted so that it can travel between the body 4 and the upper component 2 of the casing.

The upper component 2 of the casing 1 has an aperture 7 through which projects an end of the member for producing unlocking 6 so that the user of the safety belt buckle has access to this member 6 for producing the unlocking of the buckle.

The casing 1 also comprises a first opening 8 whose walls are inclined, opening out into the body 4, which defines a passage and a plane of sliding for, for example, a tab acting as a lock bolt, forming an integral part of a length of the safety belt which is to be attached.

The casing 1 also comprises a second opening 9 provided in the end of the casing, opposite the end in which the openin 8 is made. This opening 9 is provided facing an end of the body 4 and is intended, for example, to permit the passage of a means of restraint (not shown) one end of which is attached to the vehicle and the other end of which is attached to the body 4 by means, for example, of a cavity 4*a* provided in the latter, so as to form an integral part of the vehicle body 4.

According to another embodiment of the safety belt buckle according to the invention, a portion of the body 4 may project outside the casing 1 through the opening 9, so as to permit the assembled buckle to be fitted in a vehicle. This construction of the buckle enables the latter to be provided with a wider general applicability.

The safety belt buckle according to the invention also comprises a sliding block 10 mounted so that it can travel by sliding between a forward position and a rear position as will be seen later, in the said body 4, along the direction of travel of the bolt. This sliding block comprises a centering stud 11 intended to receive one end of a spring 12 for ejecting the bolt, the other end of which is centered on a stud 13 forming an integral part of the body 4.

The body 4 also comprises a tab 14 extending approximately at a right angle to the former, one of the ends of this tab 14 forming an integral part of the body 4 and the other projecting into a cavity 15 of the locking member 5. A spring 16 is arranged around this tab 14, one of its ends bearing on the body 4 and the other on a first bearing surface of the locking member, consisting of the sides of the cavity 15.

The locking member 5 has a second bearing surface 17 consisting of a shoulder formed on one of the ends of this locking member. As will be seen later, this shoulder is intended to cooperate with the member for producing unlocking 6 so as to unlock the safety belt buckle according to the invention.

In its middle portion, the locking member 5 comprises a hump 18, one wall of which acts as the articulation surface of the locking member 5 and is made to bear, under the action of the spring 16, on a pivot 19 forming an integral part of the body 4 and approximately parallel to the plane of sliding and perpendicular to the direction of travel of the bolt in the buckle, as will be described later.

The locking member 5 also comprises an operating portion responsible for retaining the bolt in the buckle, this operating portion consisting, for example, of a projection 20 formed at one of the ends of the locking member 5, this end being away from the end of the locking member in which the shoulder 17 is formed.

It should be noted that the first bearing surface of the locking member, consisting of the sides of the cavity 15, is arranged between the second bearing surface consisting of the shoulder 17 and the articulation surface consisting of a wall of the hump 18.

The sliding block 10 also comprises projecting portions 10*a* which will be described in further detail later and forming a bearing surface of the sliding block on which the projecting portion 20 comes to bear, forming a first bearing surface of the locking member, in a position in which the buckle is unlocked. In fact, the spring 12 which forms the spring for ejecting the bolt, actuates the sliding block so as to bring it into the forward position shown in FIG. 1, so that the locking member 5, one of whose ends is pushed by the spring 16, tends to swing around the pivot 19 to come into a position in which the buckle is locked, this swing being limited by the protection 20 coming to bear on the projecting portions 10*a* of the sliding block 10.

Figure 2:
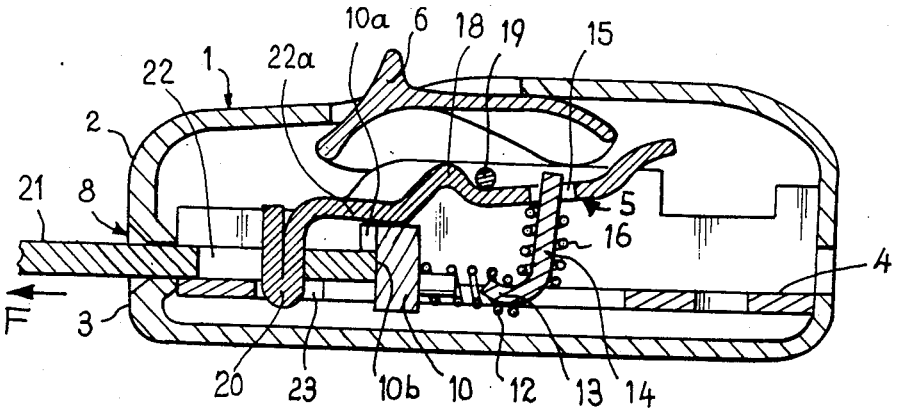

When a bolt 21 (FIG. 2) comprising a cavity 22, is introduced into the safety belt buckle, the front face of the bolt comes to bear against a bearing face 10*b* of the sliding block 10, arranged below the projecting portions 10*a* of this sliding block, these projecting portions also acting as means for guiding the bolt as it travels in the buckle. The sliding block 10 then travels under the effect of the entry of the bolt into the buckle against the spring 12, so that the projecting portion 20 of the locking member 5 is released and that the spring 16 causes the locking member 5 to swivel towards its locking position. In this position, the projecting portion 20 has passed through the cavity 22 in the bolt 21 and cooperates with a stop edge of the body, consisting of a side of an aperture 23 provided in the body 4, to retain the bolt in a position in which it is locked in the buckle. A second bearing surface of the locking member, consisting of a portion 22*a* of the metal blade forming the locking member and arranged between the projection 20 and the hump 18 of the latter, then comes to bear against the sliding block 10 and more particularly against the projecting portions 10*a* of the latter, to limit the swinging motion of the locking member.

Thus, for example, when a force F, tending to cause the bolt to come out of the buckle, is exerted on the bolt, the locking member 5 can travel slightly forward so that its projection 20 cooperates with a side of the cavity 22 and with a side of the aperture 23 to retain the bolt.

Figure 3:
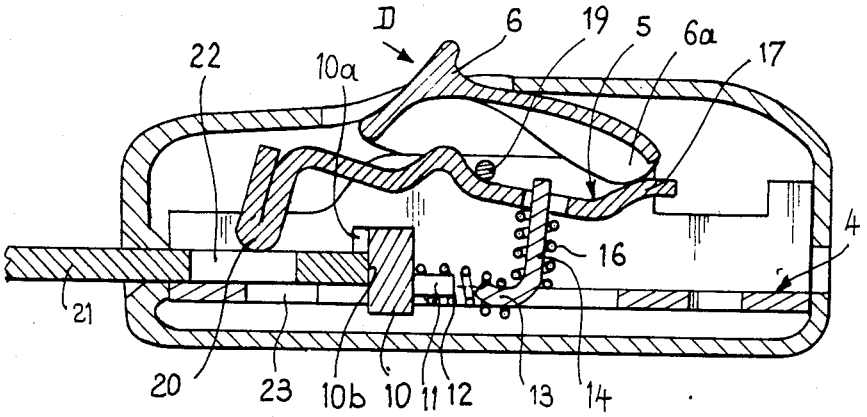
Figure 4:
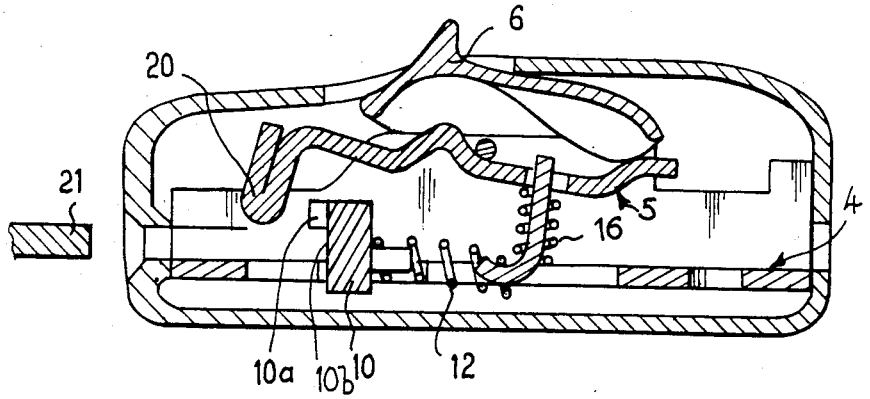

When a force D (FIG. 3) is applied to the member for producing unlocking 6 by a user who wishes to unlock the safety belt buckle according to the invention, one end 6*a* of the former comes to bear against the second bearing surface of the locking member 5, consisting of the shoulder 17, to exert an action on this member, counterwise to that exerted by the spring 16. This causes the locking member to swing on the articulation pivot 19 and causes the projecting, portion 20 of the latter to be released from the aperture 23 in the body 4 and from the cavity 22 in the bolt 21, so as to release the latter. The sliding block 10 then travels under the action of the spring 12 for ejecting the bolt, so that the bolt 21 is ejected from the buckle, as shown in FIG. 4.

The travel of the sliding block 10 continues so long as the projecting portions 10*a* have not come to bear against the projection 20 of the locking member 5.

The sliding block is therefore mounted so that it can travel between a forward position in which the buckle is unlocked, in which the first bearing surface of the locking member, consisting of the projection 20, bears against the sliding block, and a rear position, under the effect of the entry of the bolt into the buckle, corresponding to the position in which the bolt is locked and in which the second bearing surface of the locking member, consisting of the portion 22*a* of the metal blade forming the latter and arranged between the projection 20 and the hump 18, is bearing against the sliding block.

Figure 5:
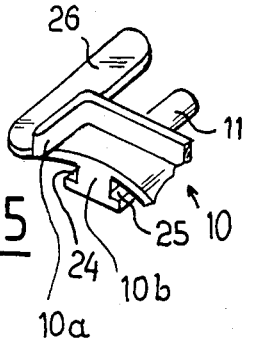
FIG. 5 shows an embodiment of a sliding block forming part of the composition of a safety belt buckle according to the invention.

As can be seen in FIG. 5, the sliding block 10 comprises projecting portions 10*a* (only one of which is shown) extending above the bearing face 10*b* of the former, which is intended to cooperate with the front face of the bolt when this is introduced into or ejected from the buckle of the safety bolt. The sliding block 10 also comprises a centring stud 11 intended to receive an end of the spring 12. This sliding block also comprises two grooves 24 and 25 and two lateral skids for guidance, only one of which, 26, is shown, which are intended to cooperate with the guidance surfaces sliding block an integral part of the body, so as to guide the sliding block during its various travels in the said body.

Figure 6:
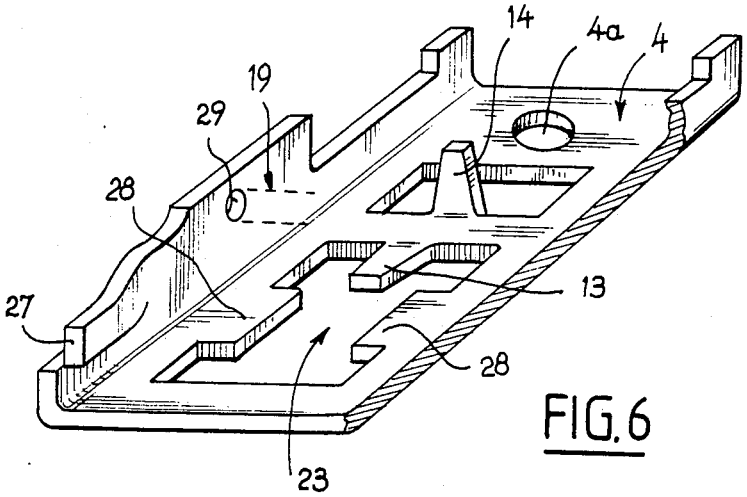
FIG. 6 shows a first embodiment of a body forming part of the composition of a safety belt according to the invention.

FIG. 6 shows an embodiment of a body 4 forming part of the composition of a safety belt buckle according to the invention. As has already been seen, this body 4 comprises a passage for the end of the bolt, this passage being bounded by two sides, only one of which, 27, is shown, and which are formed in the two arms of the U forming the said body. In its middle part, this body 4 comprises the aperture 23 which has two guidance edges 28 intended to cooperate with the grooves 24 and 25 and the guidance skids 26 of the sliding block. This body 4 also comprises the stud 13 projecting into the aperture 23 and the tab 14 intended to receive the spring 16. At its end away from the aperture 23, the body 4 has the cavity 4*a* intended to permit the attachment of a means of restraint forming an integral part of the vehicle, to the body, so as to ensure the attachment of the safety belt buckle to the vehicle.

In this embodiment, the articulation pivot 19 consists of a rod which extends between the arms of the body and whose ends are engaged in cavities 29 arranged in the two arms of this body.

Figure 7:
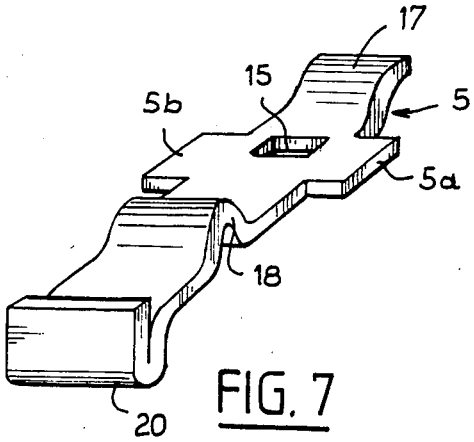
FIG. 7 shows a first embodiment of a locking member which may be used with the body shown in FIG. 6.

At one of its ends, the locking member shown in FIG. 7 comprises the projection 20 forming the operating portion of the latter, in its central portion, the hump 18, one of whose walls forms the articulation surface of this locking member and, at its other end, the shoulder 17 forming the second bearing surface intended to cooperate with the member for producing unlocking of the buckle. The cavity 15, which may be square, for example, and whose sides form the first bearing surface intended to receive an end of the spring 16, is arranged between the said second bearing surface formed by the shoulder 17 and the articulation surface formed by one of the walls of the hump 18. The locking member 5 may also have two projecting portions 5*a* and 5*b* lying on each side of this cavity 15.

Figure 8:
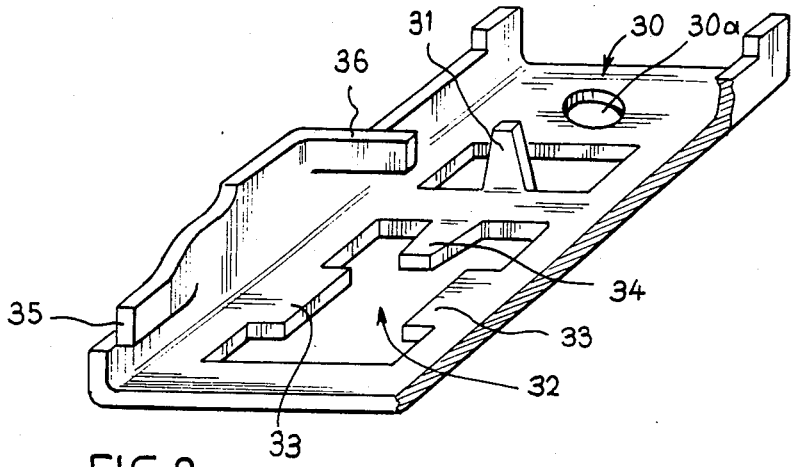
FIG. 8 shows a second embodiment of a body forming part of the composition of a safety belt buckle according to the invention.

According to a other embodiment, shown in FIG. 8, a body 30 may be generally of a shape similar to that shown in FIG. 6, that is to say comprising a cavity 30*a* for attaching the body to the vehicle body, a tab 31 extending substantially at a right angle from this body, and upon which may be arranged the means pushing the locking member towards its locking position, an aperture 32 comprising guidance edges 33 for the sliding block and a centering stud 34 intended to receive an end of the means for ejecting the bolt. Also formed in the two arms of the U forming the body are the sides 35 defining the passage for the bolt and two projecting portions 36 extending substantially at a right angle from these arms towards the interior of the body, so as to form an articulation pivot on which the articulation surface of the locking member can come to bear.

Figure 9:
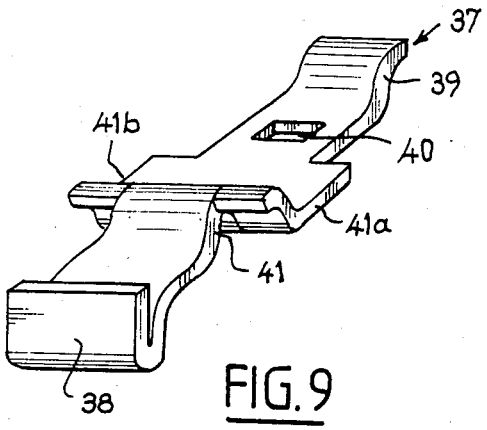
FIG. 9 shows a second embodiment of a locking member which may be used with the body shown in FIG. 8.

This locking member shown in FIG. 9 and indicated as a whole by the reference 37 comprises a locking projection 38, a shoulder 39 defining the second bearing surface of the latter, a cavity 40 intended to receive the end of the tab 31 and a hump 41 intended to define an articulation surface of the looking member on the projecting portions 36 of the body. On each side of this articulation surface are arranged arms 41*a* and 41*b* intended to compensate the shortening in length of the projecting portions 36 relative to a pivot consisting of a rod extending between the two arms of the body.

I claim:

1. Buckle, especially for a safety belt for an automobile vehicle, intended to attach in a removable manner a length of the belt to a fixed point of the vehicle body, comprising a catch assembly and a belt (21) forming an integral part of the length to be attached, the catch assembly comprising, housed in a casing (1), a body (4; 30) intended to be attached to a means of restraint forming an integral part of the vehicle and which defines a passage and a plane of sliding for the bolt, a member for locking (5; 37) the bolt comprising an operating portion (20; 38) which engages in a cavity (22) in the bolt in the position in which the latter is locked, and articulated to the body (4; 30) so as to be capable of swinging around an articulation pivot (19; 36) which is approximately parallel to the plane of sliding and perpendicular to the direction of travel of the bolt, between a position in which the bolt is locked and a position in which the bolt is unlocked, a sliding block (10) mounted in the said body so as to be capable of travelling along the direction of travel of the bolt and which cooperates, on the one hand, with a front face of the bolt and, on the other hand, with a spring for ejecting (12) the bolt, means (16) pushing the locking member towards its position in which the bolt is locked and means for producing unlocking (6) for moving the locking member (5; 37) towards its position in which the bolt is unlocked, characterized in that said sliding block (10) is mounted so that it can travel between a forward position, in which a first bearing surface of the locking member (5; 37) bears against this sliding block (10), corresponding to the position in which the bolt is unlocked, and a rear position, in which the locking member (5; 37) has oscillated relative to the body (4; 30) so that a second bearing surface of the locking member bears against the sliding block (10), corresponding to the position in which the bolt (21) is locked, in that the locking member (5; 37) is in the form of metal blade comprising at one of its ends a locking projection (20; 38) forming said operating portion of the former and cooperating, in a locking position, with a side of the cavity (22) in the bolt and with a stop edge in the body (4; 30) to retain the bolt in a locking position, in its middle part an articulation surface cooperating with said articulation pivot (9; 36) so as to enable said locking member (5; 37) to travel and at its other end both a third bearing surface for the means (16) pushing the locking member towards its locking position and a fourth bearing surface (17; 39) intended to cooperate with said means for producing unlocking (6) to move said locking member towards its unlocking position, and in that said third bearing surface consists of edges of a cavity (15; 40) arranged in said locking member (5; 37) and into which there projects one end of a tab (14; 31) whose other end is an integral part of the body (4; 30) and which extends approximately at a right angle to the body and on which is arranged a spring (16) forming the means pushing the locking member towards its locking position, one of whose ends bears on the body and the other on said third bearing surface of the locking member.

2. Buckle as claimed in claim 1 wherein the said third bearing surface is arranged between the said articulation surface and the fourth bearing surface.

3. Buckle as claimed in claim 2, wherein the said articulation surface consists of a humped surface (18; 41) formed in the middle part of the locking member.

4. Buckle as claimed in claim 3, wherein the fourth bearing surface consists of a shoulder (17; 39) formed in the said metal blade.

5. Buckle as claimed claim 1, wherein the first bearing surface of the locking member consists of the operating portion (20; 38) of the latter and wherein the second bearing surface consists of a portion (**22*a***) of the metal blade, arranged between the said operating portion and the said articulation surface.

6. Buckle as claimed in claim 1, in which the said body is U-shaped in cross-section, wherein the articulation pivot consists of a rod (19) whose ends are engaged in cavities (29) arranged in the arms of the U.

7. Buckle as claimed in claim 1, in which the said body is U-shaped in cross-section, wherein the said articulation pivot consists of two projecting portions (36) extending from the arms of the U towards the interior of the body, above the said locking member.

8. Buckle as claimed in claim 1, wherein the sliding block (10) comprises grooves (24, 25) and skids (26) for guidance, intended to cooperate with guidance surfaces of the body (4; 30).

9. Buckle as claimed in claim 8, wherein the said guidance surfaces consist of guidance edges (28; 33) forming an integral part of an aperture (23; 32) arranged in the said body (4; 30).

10. Buckle as claimed in claim 1, wherein the sliding block comprises means for guiding the front face of the bolt when it is introduced into or ejected from the said buckle.

11. Buckle as claimed in claim 10, wherein the said guiding means consist of projecting portions (**10*a*) extending above a bearing face (10*b*) of the sliding block, which face is intended to cooperate with the front bearing face (10*b*) of the bolt (21**) when it is introduced into or ejected from the buckle.

12. Buckle as claimed in claim 11, wherein the said first and second bearing surfaces of the locking member come to bear against the said projecting portions (**10*a*) of the sliding block (10**).

13. Buckle as claimed in claim 12, wherein the stop edge consists of a side of the aperture (23; 32) arranged in the said body (4; 30).

* * * * *